US011441374B2

(12) United States Patent
Xu et al.

(10) Patent No.: US 11,441,374 B2
(45) Date of Patent: Sep. 13, 2022

(54) DISPOSABLE SETTING TOOL FOR WELLBORE OPERATIONS

(71) Applicants: YingQing Xu, Tomball, TX (US); Gregory Hern, Porter, TX (US); Juan Carlos Flores Perez, The Woodlands, TX (US)

(72) Inventors: YingQing Xu, Tomball, TX (US); Gregory Hern, Porter, TX (US); Juan Carlos Flores Perez, The Woodlands, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 102 days.

(21) Appl. No.: 16/876,566

(22) Filed: May 18, 2020

(65) Prior Publication Data

US 2021/0355775 A1 Nov. 18, 2021

(51) Int. Cl.
*E21B 23/04* (2006.01)
*E21B 23/06* (2006.01)

(52) U.S. Cl.
CPC ..... *E21B 23/042* (2020.05); *E21B 23/0411* (2020.05); *E21B 23/0412* (2020.05); *E21B 23/0414* (2020.05); *E21B 23/065* (2013.01)

(58) Field of Classification Search
CPC ..... E21B 23/042; E21B 23/0412; E21B 23/0411; E21B 23/0414; E21B 23/065
See application file for complete search history.

(56) References Cited

U.S. PATENT DOCUMENTS 2,978,028 A * 4/1961 Webb ..... E21B 23/065 166/63
3,055,430 A * 9/1962 Campbell ..... E21B 33/1295 166/122
3,186,485 A 6/1965 Owen
3,298,437 A * 1/1967 Conrad ..... E21B 23/065 166/63

(Continued)

FOREIGN PATENT DOCUMENTS

CN 110374546 A 10/2019

OTHER PUBLICATIONS

International Search Report and Written Opinion for International Application No. PCT/US2021/032885; International Filing Date May 18, 2021; Report dated Sep. 8, 2021 (pp. 1-10).

*Primary Examiner* — Jonathan Malikasim
(74) *Attorney, Agent, or Firm* — Cantor Colburn LLP

(57) ABSTRACT

A disposable setting tool includes a housing having a first end, a second end, and an intermediate portion having an outer surface and an inner surface defining a passage. A piston assembly is arranged in the passage. The piston assembly including a first piston portion and a second piston portion that extends axially outwardly of the second end of the housing. The first piston portion includes a first end portion, a second end portion, and an intermediate section having an outer surface portion and an inner surface portion that extends between the first end portion and the second end portion. The inner surface portion defines a pressure passage. An atmospheric chamber is defined between the inner surface of the housing and the outer surface portion of the piston assembly.

19 Claims, 8 Drawing Sheets

(56) References Cited

U.S. PATENT DOCUMENTS

| | | | | |
|---|---|---|---|---|
| 3,677,081 | A * | 7/1972 | Newton | E21B 49/10 166/100 |
| 9,810,035 | B1 | 11/2017 | Carr et al. | |
| 11,053,759 | B2 | 7/2021 | Covalt et al. | |
| 2019/0277103 | A1 | 9/2019 | Wells et al. | |
| 2020/0115977 | A1 | 4/2020 | Norrid et al. | |

* cited by examiner

DISPOSABLE SETTING TOOL FOR WELLBORE OPERATIONS

BACKGROUND

In the resource exploration and recovery industry wellbores are drilled into a formation for the purpose of identifying and extracting formation fluids. A tubular is run into the wellbore to a selected depth. Often times the tubular will include packers or seals that, when deployed, separate the wellbore into various resource extraction zones. A setting tool is employed to radially outwardly expand the packer into contact with wellbore surfaces or an inner surface of a casing tubular.

Various setting tools are employed to radially outwardly expand the packer. Many setting tools employ a power charge that is ignited to generate pressurized gases that shift a piston operably coupled to the packer. Given that the packer is set at depth, the pressurized gases must overcome hydrostatic pressure that may be acting on the piston. Thus, the power charge must be sized to contain enough charge material to generate the necessary pressure. The size of the power charge contributes to an overall size of the setting tool. The industry would welcome a setting tool that may reduce influences of hydrostatic pressure and thus rely on a smaller power charge to enable the use of a smaller form factor.

SUMMARY

Disclosed is a disposable setting tool including a housing having a first end, a second end, and an intermediate portion having an outer surface and an inner surface defining a passage. A piston assembly is arranged in the passage. The piston assembly including a first piston portion and a second piston portion that extends axially outwardly of the second end of the housing. The first piston portion includes a first end portion, a second end portion, and an intermediate section having an outer surface portion and an inner surface portion that extends between the first end portion and the second end portion. The inner surface portion defines a pressure passage. An atmospheric chamber is defined between the inner surface of the housing and the outer surface portion of the piston assembly.

Also disclosed is a resource exploration and recovery system including a surface system and a subterranean system including a tubular string extending into a wellbore and a disposable setting tool extending from the surface system into the tubular string. The disposable setting tool includes a housing having a first end, a second end, and an intermediate portion including an outer surface and an inner surface defining a passage. A piston assembly is arranged in the passage. The piston assembly includes a first piston portion and a second piston portion that extends axially outwardly of the second end of the housing. The first piston portion includes a first end portion, a second end portion, and an intermediate section having an outer surface portion and an inner surface portion that extends between the first end portion and the second end portion. The inner surface portion defines a pressure passage. An atmospheric chamber is defined between the inner surface of the housing and the outer surface portion of the piston assembly.

Further disclosed is a method of setting a subterranean device including igniting a power charge in a power charge chamber of a disposable setting tool to form a pressurized gas, directing the pressurized gas outwardly of the power charge chamber, shifting a first member relative to a second member with the pressurized gas, and compressing an atmospheric gas arranged in an atmospheric chamber arranged between the first member and the second member, wherein shifting the second me member sets the subterranean device.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
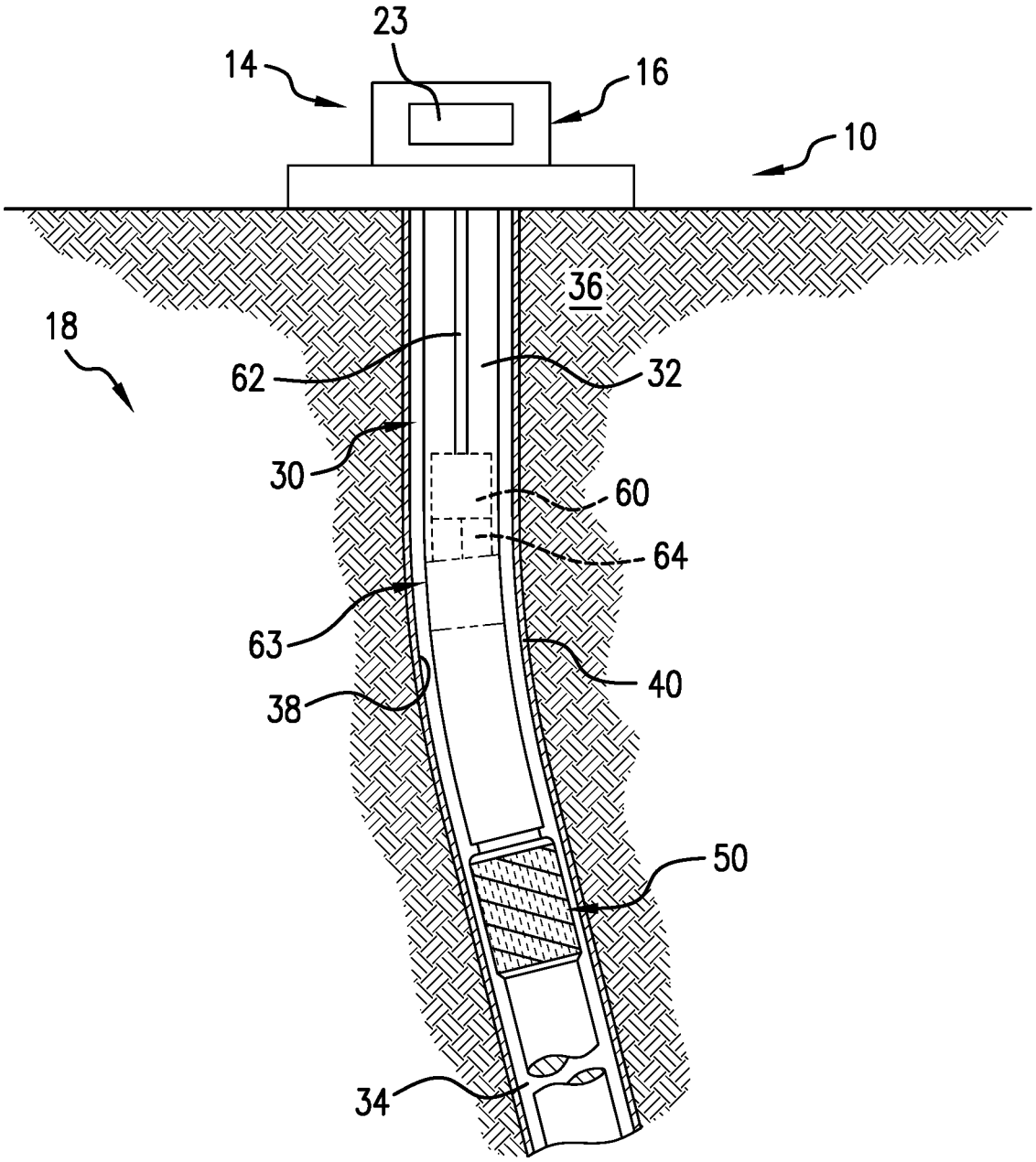
FIG. 1 depicts a resource exploration and recovery system including a disposable setting tool, in accordance with an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subterranean system. First system 14 may include a control system 23 that may provide power to, monitor, communicate with, and/or activate one or more downhole operations as will be discussed herein. Surface system 16 may include additional systems such as pumps, fluid storage systems, cranes and the like (not shown).

Second system 18 may include a tubular string 30, formed from one or more tubulars 32, which extends into a wellbore 34 formed in formation 36. Wellbore 34 includes an annular wall 38 which may be defined by a surface of formation 36, or a casing tubular 40 such as shown. Tubular string 30 may support one or more screen assemblies 50.

In an embodiment, a disposable setting tool 60 may be run into tubular string 30 on, for example, a wireline 62. In an embodiment, disposable setting tool 60 may be connected to a packer assembly 63 arranged within tubular string 30 and/or support one or more slips 64. Disposable setting tool 60 may be selectively activated to radially outwardly expand packer assembly 63 and/or slips 64 into contact with internal surfaces of tubular sting 30.

Figure 2:
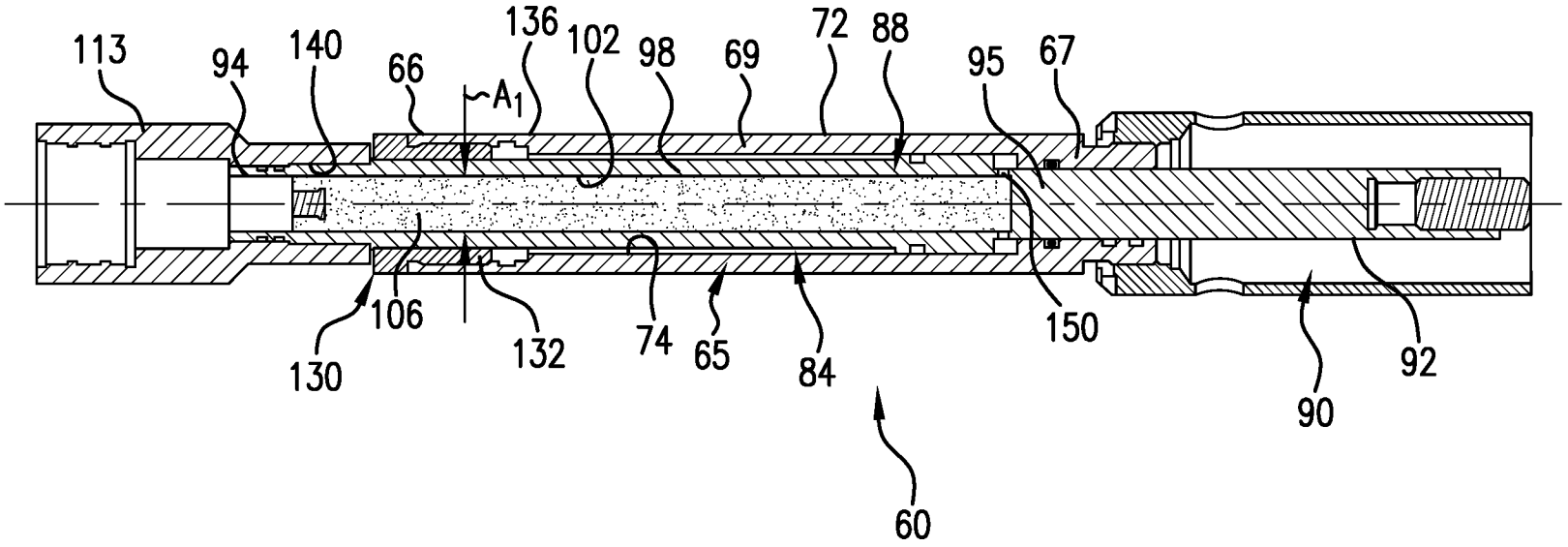
FIG. 2 depicts a cross-sectional side view of the disposable setting tool of FIG. 1 in a run-in configuration, in accordance with an aspect of an exemplary embodiment.
Figure 3:
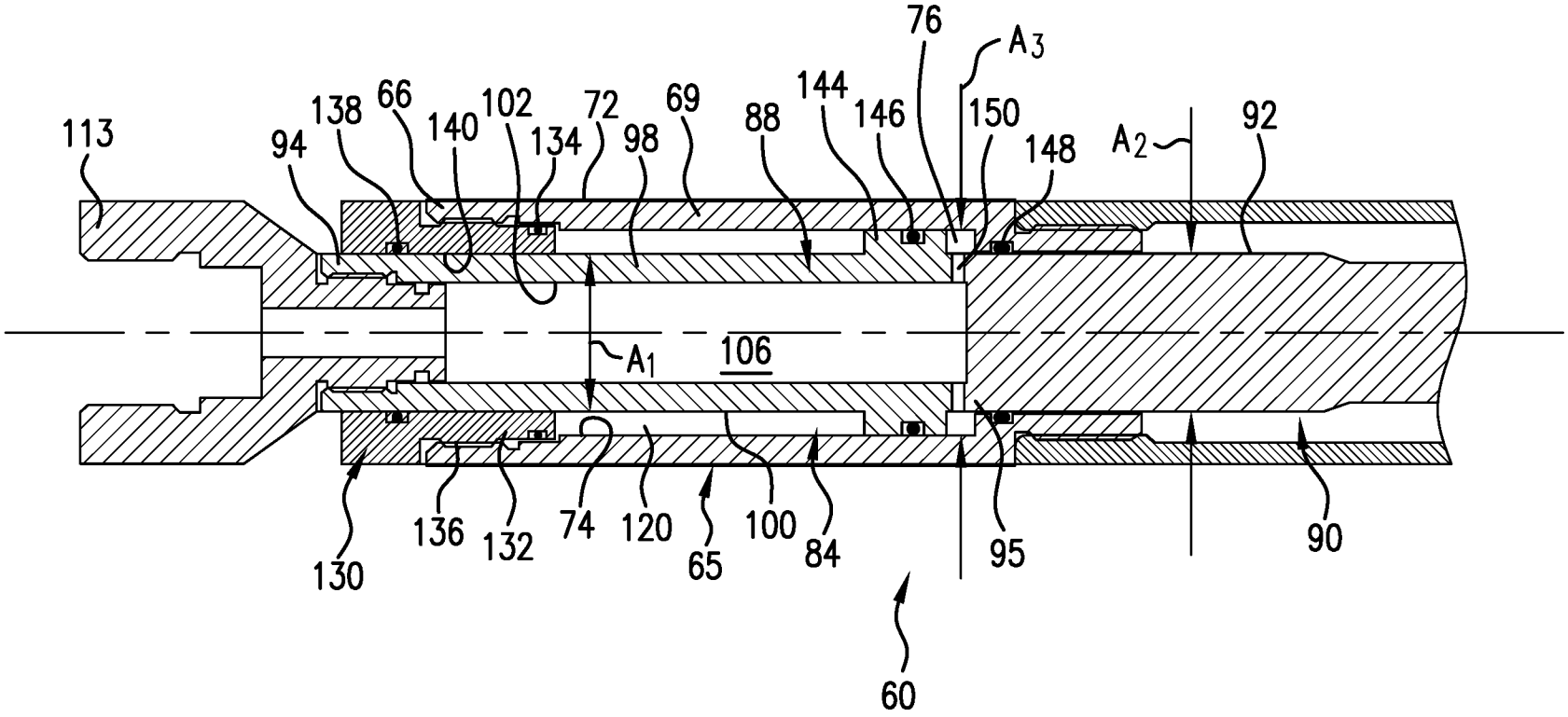
FIG. 3 depicts a partial cross-sectional side view of the disposable setting tool of FIG. 2, in accordance with an aspect of an exemplary embodiment.

Referring to FIGS. 2 and 3, disposable setting tool 60 includes a housing 65 having a first end 66 and an opposing second end 67. An intermediate portion 69 extends between first end 66 and second end 67. Intermediate portion 69 includes an outer surface 72 and an inner surface 74 that defines a passage 76. Housing 65 may be formed from first and second housing portions (not separately labeled) that are joined one to another.

A piston assembly 84 is arranged in passage 76. Piston assembly 84 includes a first piston portion 88 and a second piston portion 90. Second piston portion 90 includes an outer surface zone 92 and extends axially outwardly of second end 67 of housing 65 and is operatively connected to packer assembly 42. First piston portion 88 includes a first end portion 94 and a second end portion 95. An intermediate section 98 extends between first end portion 94 and second end portion 95. Intermediate section 98 includes an outer surface portion 100 that is spaced from inner surface 74 of housing 65 and an inner surface portion 102 that defines a pressure passage shown as a power charge chamber 106. First end portion 94 of first piston portion 88 includes a firing head adapter 113 that connects to a firing head (not shown) that ignites a power charge (not separately labeled) in power charge chamber 106.

In accordance with an exemplary aspect, an atmospheric chamber 120 is defined between inner surface 74 of housing 65 and outer surface portion 100 of first piston portion 88. As will be detailed below, atmospheric chamber 120 allows piston assembly 84 to overcome hydrostatic pressure without the need to employ a large power charge.

In the embodiment shown, a cap member 130 is provided at first end 66 of housing 65. Cap member 130 includes a flange 132 that extends into passage 76. A first seal 134 is disposed on an outer surface 136 of flange 132 and a second seal 138 is disposed on an inner surface 140 of flange 132. First seal 134 seals against inner surface 74 of housing 65 and second seal 138 seals against outer surface portion 100 of first piston portion 88. An annular rib 144 is provided on first piston portion 88 adjacent to second end portion 95. A third seal 146 is provided on annular rib 144. Third seal 146 seals against inner surface 74 of housing 65. Atmospheric chamber 120 is defined between second seal 138 and third seal 146. An outlet 150 is provided between annular rib 144 and second piston portion 90. Outlet 150 fluidically connects power charge chamber 106 and passage 76.

Figure 4:
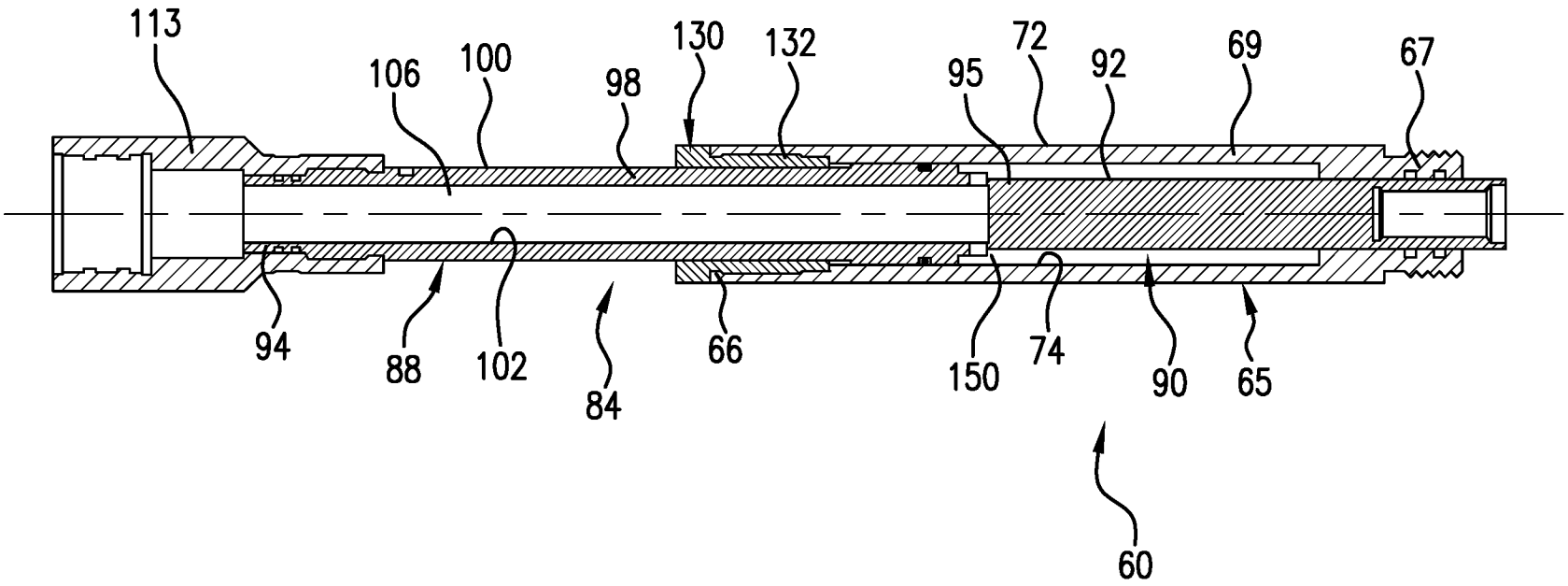
FIG. 4 depicts a partial cross-sectional view of the disposable setting tool of FIG. 2 in a deployed configuration, in accordance with an aspect of an exemplary embodiment.

In accordance with an exemplary aspect, when it is desired to expand packer assembly 42, an energy source (not shown) ignites the powder in power charge chamber 106. Hot gases pass through outlet 150 and enter into passage 76. The hot gases cause piston assembly 84 to shift axially away from housing 65 from a first or run-in position (FIG. 2) to a second or deployed position (FIG. 4). As piston assembly 84 shifts, annular rib 144 compresses gases in atmospheric chamber 120. The gases in atmospheric chamber 120 are at a much lower pressure that hydrostatic pressure that exists in wellbore 34.

In further accordance with the embodiment shown, outer surface portion 100 of first piston portion 88 defines a first area (A1) and outer surface zone 92 of second piston portion 90 defines a second area (A2), and annular or donut shaped area A3 defined between seal 146 and 148. In an exemplary aspect, A1 and A2 are substantially identical. With the presence of atmospheric chamber 120, any hydrostatic pressure acting on first piston portion 88 is cancelled out by hydrostatic pressure acting on second piston portion 90. With this arrangement, output force applied to shift piston assembly 84 is:

$$P*A$$

where P=Power charge Pressure; and

A=A3.

Thus, the presence of atmospheric chamber negates any effects applied by hydrostatic pressure and thereby allows for the use of a smaller power charge than would otherwise be needed. The use of a smaller power charge allows the disposable setting tool to have a shorter form factor.

Figure 5:
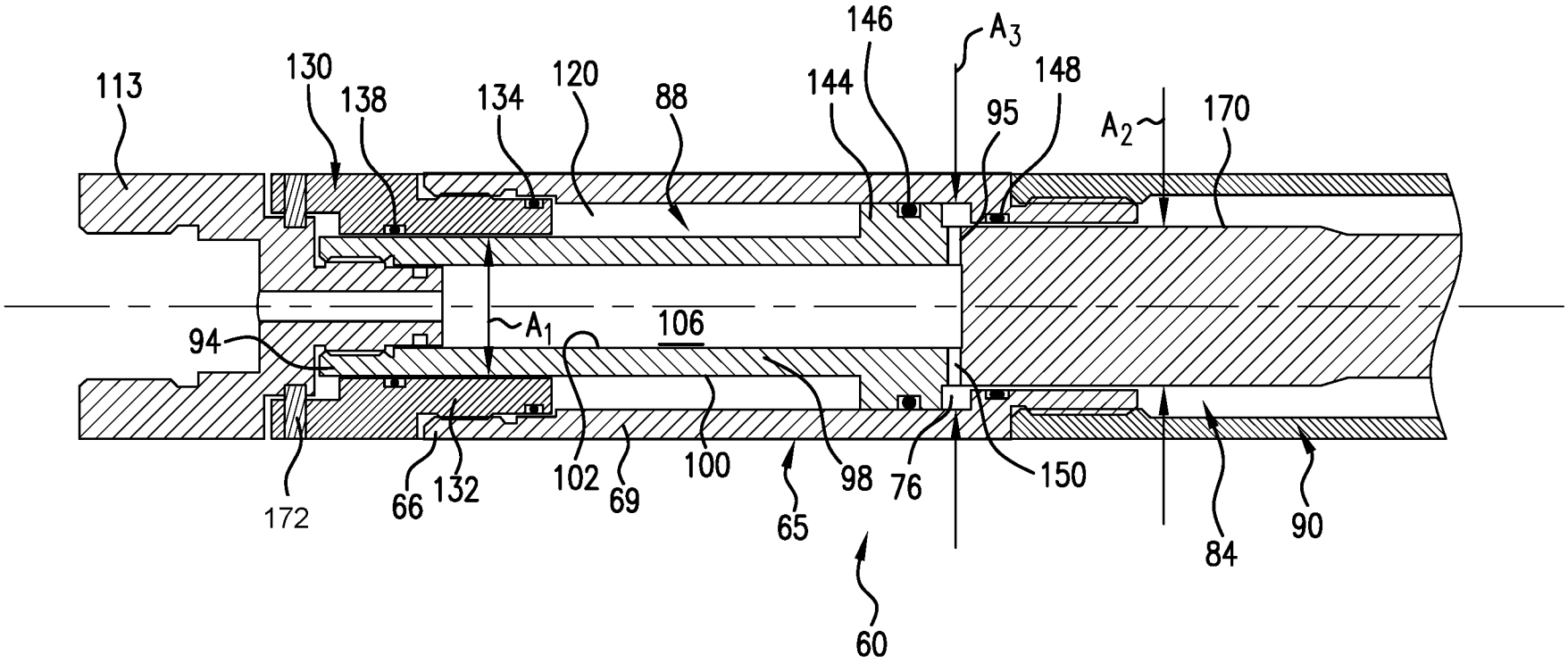
FIG. 5 depicts a partial cross-sectional side view of a disposable setting tool, in accordance with another aspect of an exemplary embodiment.

Reference will follow to FIG. 5, wherein like reference numbers represent corresponding parts in the respective views in describing second piston portion 90 in accordance with another aspect of an exemplary embodiment. Second piston portion 90 includes an outer surface zone 170 defines a second area A2 that is larger than the first are Al defined by outer surface portion 100 of first piston portion 88. With this arrangement, output force applied to shift piston assembly 84 is:

$P*A3$+Phyd*$(A2-A1)$ where $P$=Power charge Pressure, and P(hyd)=Hydrostatic pressure.

By making A2 greater than Al, hydrostatic pressure acting upon second piston portion 90 may contribute to shifting piston assembly 84. As such, piston assembly 84 is secured to housing 65 through one or more frangible elements, one of which is indicated at 172 Pressure from the expanding gases created by igniting the power charge coupled with hydrostatic pressure acting on second piston portion 90 breaks frangible elements 172 allowing piston assembly 84 to shift and set packet assembly 42.

Figure 6:
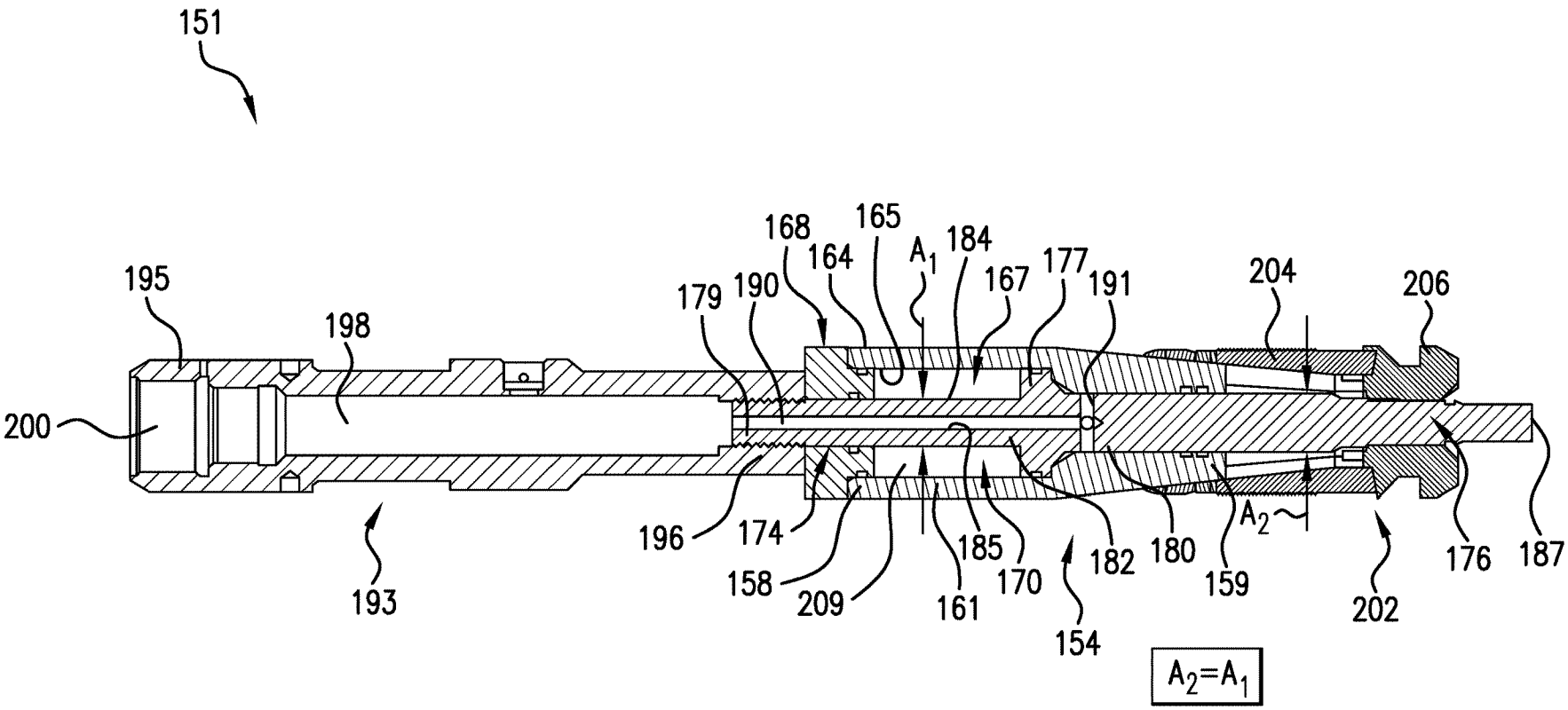
FIG. 6 depicts a cross-sectional side view of a disposable setting tool in accordance with yet another aspect of an exemplary embodiment.

Reference will now follow to FIG. 6 in describing a disposable setting tool 151 in accordance with another exemplary embodiment. Disposable setting tool 151 includes a housing 154 shown in the form of a setting cone (not separately labeled). Housing 154 includes a first end 158, a second end 159, and an intermediate portion 161. Housing 154 is also shown to include an outer surface 164 and an inner surface 165 that defines a passage 167. A cap member 168 is arranged at first end 158 of housing 154. A piston assembly 170 extends through housing 154.

Piston assembly 170 is shown in the form of a mandrel (not separately labeled) having a first piston portion 174 and a second piston portion 176. A piston element 177 is arranged between first piston portion 174 and second piston portion 176. First piston portion 174 includes a first end portion 179, a second end portion 180, and an intermediate section 182. First piston portion 174 includes an outer surface 184 and an inner surface 185. Second end piston portion 176 extends from second end portion 180 of first piston portion 174 to a terminal end 187. Inner surface portion 185 defines a pressure passage 190 that extends from first end portion 179 to a plurality of outlets 191 arranged at second end portion 180.

Disposable setting tool 151 also includes a power charge portion 193 connected to piston assembly 170. Power charge portion 193 includes a first end section 195 and a second end section 196 with a power charge chamber 198 extending therebetween. First piston portion 174 includes a first diameter A1 and second piston portion 176 includes a second diameter A2 that is substantially equal to A1. First end section 195 defines a firing head adaptor 200. Disposable setting tool 151 further includes a slip assembly 202 including one or more slips 204 and an end member 206 coupled to terminal end of second piston portion 176.

In an embodiment, an atmospheric chamber 209 is defined in passage 167 between inner surface 165 and outer surface 184 of first piston portion 174. In operation, disposable setting tool 151 is run into wellbore 34 to a selected depth. A power charge (not shown) in power charge chamber 198 is ignited causing high pressure gases to flow along pressure passage 190 and pass from piston assembly 170 through outlets 191 into housing 154. The high pressure gases act on piston element 177 forcing housing 154 along second piston portion 176 and into slip assembly 202 causing a radially outward expansion of slip(s) 204. With A1 and A2 being substantially equal, the presence of atmospheric chamber 209 eliminates the effects of hydrostatic pressure acting on housing 154. Thus, the high pressure gases generated in power charge chamber 198 need only act to move housing 154 and need not counter-at hydrostatic pressure. Once set, housing 154 and slips 204 may form a tool, such as a plug (not separately labeled) that remains in wellbore 34 when disposable setting tool 151 is run out.

Figure 7:
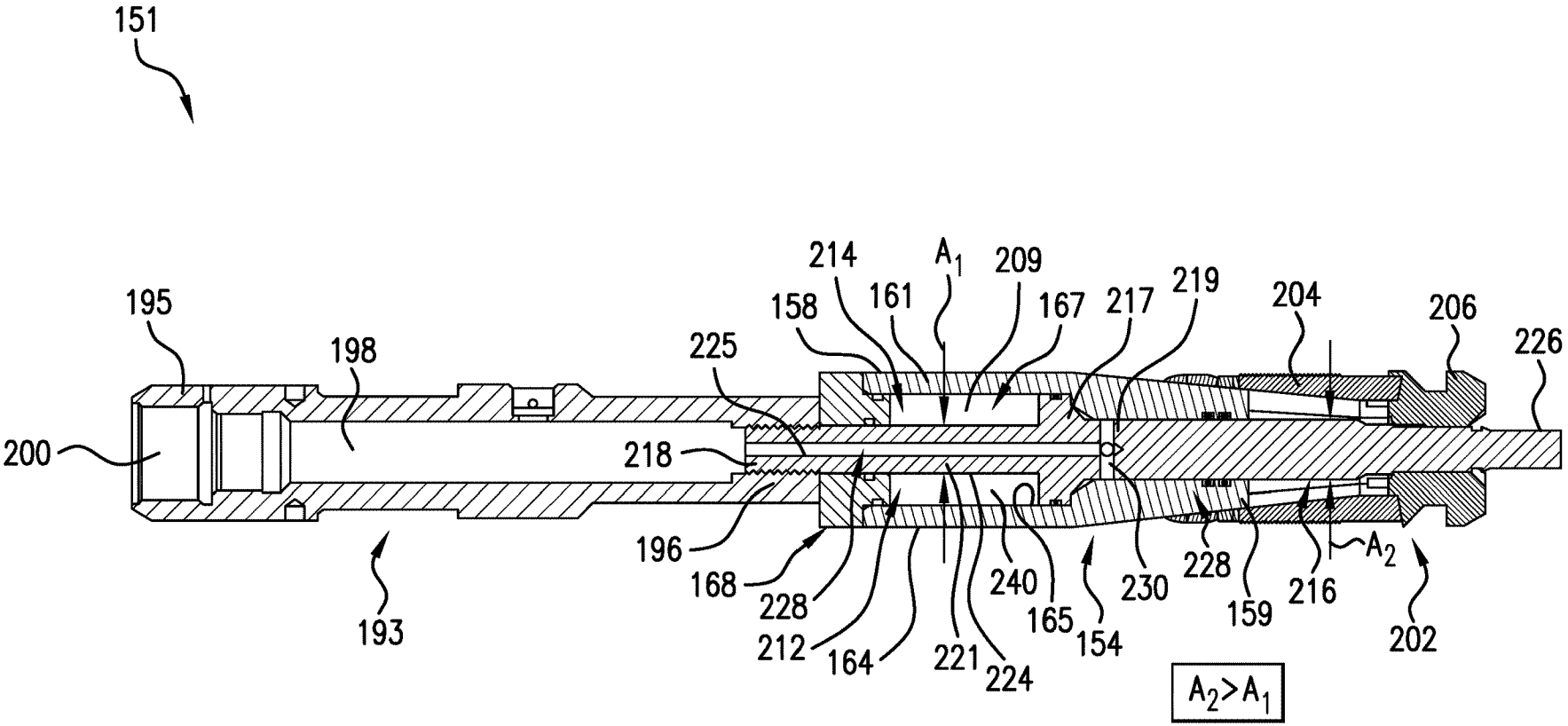
FIG. 7 depicts a cross-sectional side view of a disposable setting tool in accordance with still yet another aspect of an exemplary embodiment.
Figure 8A:
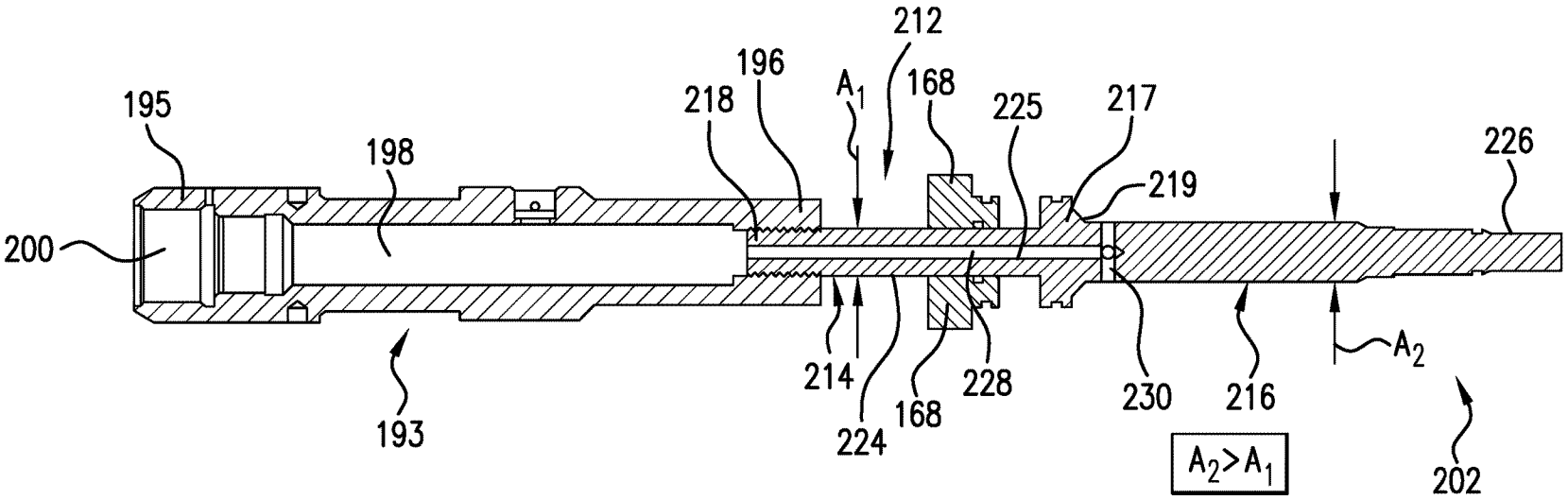
FIG. 8A depicts a cross-sectional side view of a power charge portion and piston assembly portion of the disposable setting tool of FIG. 7.
Figure 8B:
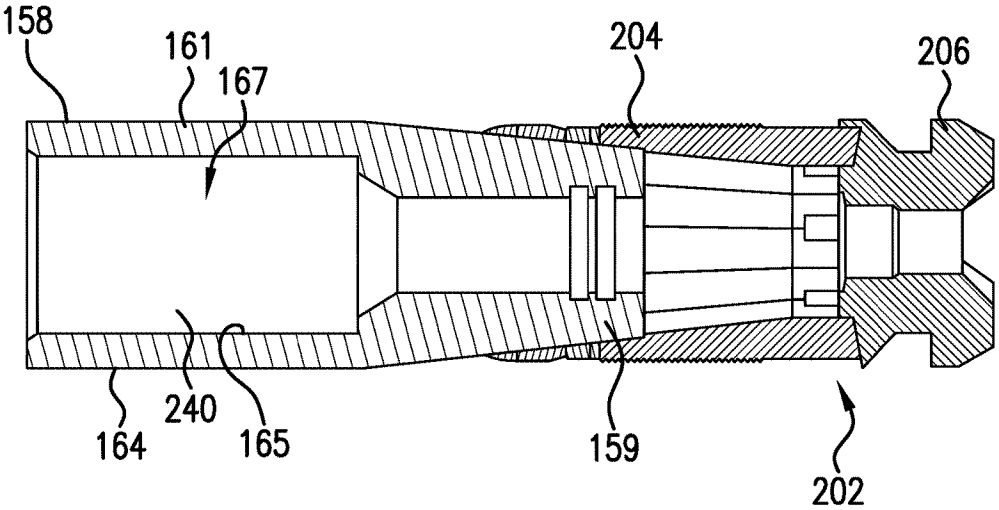
FIG. 8B depicts a cross-sectional side view of housing portion and slip assembly portion of the disposable setting tool of FIG. 7.

Reference will now follow to FIGS. 7, 8A, and 8B in describing a piston assembly 212 for disposable setting tool 151 in accordance with another aspect of an exemplary embodiment. Piston assembly 212 includes a first piston portion 214 and a second piston portion 216. A piston element 217 is arranged between first piston portion 214 and second piston potion 216. First piston portion 214 includes a first end portion 218, a second end portion 219, and an intermediate section 221 extending therebetween. First piston portion 214 includes an outer surface portion 224 with an outer diameter A1 and an inner surface portion 225. Second piston portion 216 includes an outer diameter A2 that is greater than A1 and extends from first piston portion 214 to a terminal end portion 226. A pressure passage 228 extends from first end portion 218 to a plurality of outlets 230 arranged at second end portion 219.

In an embodiment, an atmospheric chamber 240 is defined in passage 167 between inner surface 165 ad first piston portion 214. In operation, disposable setting tool 151 is run into wellbore 34 to a selected depth. A power charge (not shown) in power charge chamber 198 is ignited causing high pressure gases to flow along pressure passage 228 and pass from piston assembly 212 into housing 154 via outlets 230. The high pressure gases act on piston element 217 forcing housing 154 along second piston portion 216 and into slip assembly 202 causing a radially outward expansion of slip(s) 204.

With A2 being greater than A1, the presence of atmospheric chamber 209 allows hydrostatic pressure acting on housing 154 to aid in setting slips 204. Thus, the high pressure gases generated in power charge chamber 198 may actually be less that would be needed to move housing 154. Once set, second piston portion 216 may be disconnected from end member 206 by shearing threads, breaking a frangible link or the like. Piston assembly 212 and cap member 168 may be removed from housing 154 together with power charge portion 193 and removed from wellbore 34. Thus, in a manner similar to that discussed herein, once set, housing 154 and slips 204 may form a tool, such as a plug (not separately labeled) that remains in wellbore 34 when disposable setting tool 151 is run out.

Set forth below are some embodiments of the foregoing disclosure:

Embodiment 1. A disposable setting tool comprising: a housing, including a first end, a second end, and an intermediate portion having an outer surface and an inner surface defining a passage; and a piston assembly arranged in the passage, the piston assembly including a first piston portion and a second piston portion that extends axially outwardly of the second end of the housing, the first piston portion including a first end portion, a second end portion, and an intermediate section having an outer surface portion and an inner surface portion that extends between the first end portion and the second end portion, the inner surface portion defining a pressure passage, wherein an atmospheric chamber is defined between the inner surface of the housing and the outer surface portion of the piston assembly.

Embodiment 2. The disposable setting tool according to any prior embodiment, further comprising: a first seal arranged at the outer surface portion of the first piston portion at the first end portion and a second seal arranged at the outer surface portion of the first piston portion at the second end, the atmospheric chamber being defined between the first seal and the second seal.

Embodiment 3. The disposable setting tool according to any prior embodiment, further comprising a cap member arranged at the first end of the housing, the cap member including a flange that extends into the passage, the first seal being arranged between the flange and the inner surface.

Embodiment 4. The disposable setting tool according to any prior embodiment, wherein the second seal is provided on the first piston portion.

Embodiment 5. The disposable setting tool according to any prior embodiment, wherein the second end portion of the first piston portion includes an outlet fluidically exposed to the passage.

Embodiment 6. The disposable setting tool according to any prior embodiment, wherein the outlet is positioned axially outwardly of the second seal toward the second piston portion and is fluidically isolated from the atmospheric chamber.

Embodiment 7. The disposable setting tool according to any prior embodiment, further comprising: a frangible connector arranged between the first end of the housing and the first end portion of the first piston portion.

Embodiment 8. The disposable setting tool according to any prior embodiment, wherein the housing defines a setting cone and the piston assembly defines a mandrel.

Embodiment 9. The disposable setting tool according to any prior embodiment, further comprising: a slip assembly mechanically connected to the mandrel, wherein the slip assembly and the housing form a tool configured to remain in a wellbore when the disposable setting tool is removed.

Embodiment 10. The disposable setting tool according to any prior embodiment, wherein the first piston portion includes a first end portion and a second end portion, the first end portion being fixedly connected to power charge portion.

Embodiment 11. The disposable setting tool according to any prior embodiment, wherein the first piston portion includes a first area and the second piston portion includes a second area, wherein, when the first area is substantially equal to the second area, the hydrostatic pressure balances hydrostatic forces on the piston assembly, and wherein when the second area is greater than the first area, the hydrostatic pressure allows hydrostatic forces to contribute to a setting force on the piston assembly.

Embodiment 12. A resource exploration and recovery system comprising: a surface system; and a subterranean system including a tubular string extending into a wellbore and a disposable setting tool extending from the surface system into the tubular string, the disposable setting tool comprising: a housing including a first end, a second end, and an intermediate portion having an outer surface and an inner surface defining a passage; and a piston assembly arranged in the passage, the piston assembly including a first piston portion and a second piston portion that extends axially outwardly of the second end of the housing, the first piston portion including a first end portion, a second end portion, and an intermediate section having an outer surface portion and an inner surface portion that extends between the first end portion and the second end portion, the inner surface portion defining a pressure passage, wherein an atmospheric chamber is defined between the inner surface of the housing and the outer surface portion of the piston assembly.

Embodiment 13. The resource exploration and recovery system according to any prior embodiment, further comprising: a first seal arranged at the outer surface portion of the first piston portion at the first end portion and a second seal arranged at the outer surface portion of the first piston portion at the second end, the atmospheric chamber being defined between the first seal and the second seal.

Embodiment 14. The resource exploration and recovery system according to any prior embodiment, further comprising a cap member arranged at the first end of the housing, the cap member including a flange that extends into the passage, the first seal being arranged between the flange and the inner surface.

Embodiment 15. The resource exploration and recovery system according to any prior embodiment, wherein the second seal is provided on the first piston portion.

Embodiment 16. The resource exploration and recovery system according to any prior embodiment, wherein the second end portion of the first piston portion includes an outlet fluidically exposed to the passage.

Embodiment 17. The resource exploration and recovery system according to any prior embodiment, wherein the outlet is positioned axially outwardly of the second seal toward the second piston portion and is fluidically isolated from the atmospheric chamber.

Embodiment 18. The resource exploration and recovery system according to any prior embodiment, further comprising: a frangible connector arranged between the first end of the housing and the first end portion of the first piston portion.

Embodiment 19. The disposable setting tool according to any prior embodiment, wherein the housing defines a setting cone that forms part of a downhole tool that remains in a wellbore when the piston assembly is removed.

Embodiment 20. A method of setting a subterranean device comprising: igniting a power charge in a power charge chamber of a disposable setting tool to form a pressurized gas; directing the pressurized gas outwardly of the power charge chamber; shifting a first member relative to a second member with the pressurized gas; and compressing an atmospheric gas arranged in an atmospheric chamber arranged between the first member and the second member, wherein shifting the second member sets the subterranean device.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A disposable setting tool comprising:

a housing defining a setting cone including a first end, a second end, and an intermediate portion extending between the first end and the second end, the intermediate portion having an outer surface and an inner surface defining a passage;

a piston assembly defining a mandrel arranged in the passage, the piston assembly including a first piston portion and a second piston portion that extends axially outwardly of the second end of the housing, the first piston portion including a first end portion, a second end portion, and an intermediate section extending between the first end portion and the second end portion, the intermediate section having an outer surface portion and an inner surface portion, the inner surface portion defining a pressure passage, wherein an atmospheric chamber is defined between the inner surface of the housing and the outer surface portion of the piston assembly;

a first seal arranged at the outer surface portion of the first piston portion at the first end portion; and a cap member arranged at the first end of the housing, the cap member including a flange that extends into the passage, the first seal being arranged between the cap member and the inner surface.

2. The disposable setting tool according to claim 1, further comprising: a second seal arranged at the outer surface portion of the first piston portion at the second end portion, the atmospheric chamber being defined between the first seal and the second seal.

3. The disposable setting tool according to claim 2, wherein the second seal is provided on the first piston portion.

4. The disposable setting tool according to claim 2, wherein the second end portion of the first piston portion includes an outlet fluidically exposed to the passage.

5. The disposable setting tool according to claim 4, wherein the outlet is positioned axially outwardly of the second seal toward the second piston portion and is fluidically isolated from the atmospheric chamber.

6. The disposable setting tool according to claim 1, further comprising: a frangible connector arranged between the first end of the housing and the first end portion of the first piston portion.

7. The disposable setting tool according to claim 1, further comprising: a slip assembly mechanically connected to the mandrel, wherein the slip assembly and the housing form a tool configured to remain in a wellbore when the disposable setting tool is removed.

8. The disposable setting tool according to claim 7, wherein the first end portion of the first piston portion is fixedly connected to a power charge portion.

9. The disposable setting tool according to claim 1, wherein the first piston portion includes a first area and the second piston portion includes a second area that is substantially equal to the first area.

10. A resource exploration and recovery system comprising:

a surface system; and a subterranean system including a tubular string extending into a wellbore and a disposable setting tool extending from the surface system into the tubular string, the disposable setting tool comprising:

a housing defining a setting cone including a first end, a second end, and an intermediate portion extending between the first end and the second end, the intermediate portion having an outer surface and an inner surface defining a passage; and a piston assembly defining a mandrel arranged in the passage, the piston assembly including a first piston portion and a second piston portion that extends axially outwardly of the second end of the housing, the first piston portion including a first end portion, a second end portion, and an intermediate section extending between the first end portion and the second end portion, the intermediate section having an outer surface portion and an inner surface portion, the inner surface portion defining a pressure passage, wherein an atmospheric chamber is defined between the inner surface of the housing and the outer surface portion of the piston assembly;

a first seal arranged at the outer surface portion of the first piston portion at the first end portion; and a cap member arranged at the first end of the housing, the cap member including a flange that extends into the passage, the first seal being arranged between the cap member and the inner surface.

11. The resource exploration and recovery system according to claim 10, further comprising: a second seal arranged at the outer surface portion of the first piston portion at the second end portion, the atmospheric chamber being defined between the first seal and the second seal.

12. The resource exploration and recovery system according to claim 11, wherein the second seal is provided on the first piston portion.

13. The resource exploration and recovery system according to claim 11, wherein the second end portion of the first piston portion includes an outlet fluidically exposed to the passage.

14. The resource exploration and recovery system according to claim 13, wherein the outlet is positioned axially outwardly of the second seal toward the second piston portion and is fluidically isolated from the atmospheric chamber.

15. The resource exploration and recovery system according to claim 10, further comprising: a frangible connector arranged between the first end of the housing and the first end portion of the first piston portion.

16. The disposable setting tool according to claim 10, wherein the housing defines the setting cone that forms part of a downhole tool that remains in the wellbore when the piston assembly is removed.

17. The resource exploration and recovery system according to claim 10, wherein the first piston portion includes a first area and the second piston portion includes a second area that is substantially equal to the first area.

18. A method of setting a subterranean device comprising: igniting a power charge in a power charge chamber of a disposable setting tool to form a pressurized gas;

directing the pressurized gas outwardly of the power charge chamber; shifting a first member defining a mandrel arranged in a passage of a second member defining a setting cone with the pressurized gas, the second member including a cap member having a flange that extends into the passage; and compressing an atmospheric gas arranged in an atmospheric chamber arranged between the first member and the second member, wherein shifting the first member sets the subterranean device.

19. The method according to claim 18, wherein hydrostatic pressure acting on the first member from above the setting tool is cancelled by hydrostatic pressure acting on the first member from below the setting tool.

* * * * *